US008607581B2

(12) United States Patent
Williams et al.

(10) Patent No.: US 8,607,581 B2
(45) **Date of Patent: *Dec. 17, 2013**

(54) PACKAGE HAVING PHASE CHANGE MATERIALS AND METHOD OF USE IN TRANSPORT OF TEMPERATURE SENSITIVE PAYLOAD

(75) Inventors: Preston Noel Williams, Richfield, MN (US); Henry Adolf Cousineau, III, Minneapolis, MN (US); Arnold Charles Hillman, Prior Lake, MN (US); Christian Peter Kramer, St. Louis Park, MN (US); David Nicholas Legas, Bloomington, MN (US)

(73) Assignee: Entropy Solutions, Inc., Minneapolis, MN (US)

( * ) Notice: Subject to any disclaimer, the term of this patent is extended or adjusted under 35 U.S.C. 154(b) by 35 days.

This patent is subject to a terminal disclaimer.

(21) Appl. No.: 13/069,230

(22) Filed: Mar. 22, 2011

(65) Prior Publication Data

US 2011/0168727 A1 Jul. 14, 2011

Related U.S. Application Data

(63) Continuation of application No. 12/115,530, filed on May 5, 2008, now Pat. No. 7,908,870.

(60) Provisional application No. 60/916,207, filed on May 4, 2007, provisional application No. 60/939,167, filed on May 21, 2007, provisional application No. 60/938,622, filed on May 17, 2007.

(51) Int. Cl.
*F25D 25/00* (2006.01)

(52) U.S. Cl.
USPC ..... 62/62; 62/530

(58) Field of Classification Search
USPC ..... 62/62, 530, 371, 457.1, 457.2; 220/592.26, 721, 722; 428/34.2, 35.7
See application file for complete search history.

(56) References Cited

U.S. PATENT DOCUMENTS

| | | | | |
|---|---|---|---|---|
| 6,104,611 | A * | 8/2000 | Glover et al. | 361/700 |
| 6,244,458 | B1 | 6/2001 | Frysinger et al. | |
| 6,482,332 | B1 * | 11/2002 | Malach | 252/70 |
| 6,718,776 | B2 * | 4/2004 | Wessling et al. | 62/60 |
| 6,765,031 | B2 * | 7/2004 | Salyer et al. | 521/99 |
| 6,875,486 | B2 * | 4/2005 | Miller | 428/34.1 |
| 7,041,123 | B2 | 5/2006 | Stapf et al. | |
| 7,147,626 | B2 | 12/2006 | Goodman et al. | |
| 7,250,576 | B2 * | 7/2007 | Colgan et al. | 174/260 |
| 7,257,963 | B2 | 8/2007 | Mayer | |
| 7,294,374 | B2 * | 11/2007 | Romero | 428/34.1 |

(Continued)

OTHER PUBLICATIONS

International Search Report and Written Opinion Mailed Aug. 8, 2008 for PCT/US2008/062716.

*Primary Examiner* — Mohammad M Ali
(74) *Attorney, Agent, or Firm* — Briggs and Morgan, P.A.

(57) ABSTRACT

The present invention is directed to a transport package which efficiently maintains payload temperature within a predetermined temperature range during delivery through regions having ambient temperatures outside the desired range. The transport package is used for transporting temperature sensitive materials and thermally protecting the materials from cold and hot ambient temperatures in a manner that does not require a power source or other mechanical devices. Aspects of the invention relate to a temperature maintaining packaging system having an outer container, thermal insulation materials and two or more different phase change materials.

12 Claims, 3 Drawing Sheets

(56) References Cited

U.S. PATENT DOCUMENTS

| | | | |
|---|---|---|---|
| 7,422,143 | B2 | 9/2008 | Mayer |
| 7,500,593 | B2 | 3/2009 | Mayer |
| 2001/0048984 | A1 | 12/2001 | Legare |
| 2002/0134962 | A1 | 9/2002 | Romero |
| 2003/0097164 | A1 | 5/2003 | Stapf et al. |
| 2004/0079793 | A1 | 4/2004 | Mayer |
| 2004/0151851 | A1 | 8/2004 | Miller |
| 2004/0231355 | A1 | 11/2004 | Mayer |
| 2005/0150244 | A1 | 7/2005 | Hillmann et al. |
| 2007/0043328 | A1 | 2/2007 | Goodman et al. |

* cited by examiner

PACKAGE HAVING PHASE CHANGE MATERIALS AND METHOD OF USE IN TRANSPORT OF TEMPERATURE SENSITIVE PAYLOAD

RELATED APPLICATIONS

This application is a continuation of U.S. patent application Ser. No. 12/115,530, filed May 5, 2008, which claims priority under 35 U.S.C. 119(e) from provisional U.S. Patent Applications No. 60/916,207 filed May 4, 2007, No. 60/938,622 filed May 17, 2007, and No. 60/939,167 filed May 21, 2007, the contents of which are incorporated herein by reference.

TECHNICAL FIELD

The present disclosure is directed to a transport package for a temperature sensitive payload and a method of use within hostile environments having temperatures outside a desired temperature range for payload protection.

BACKGROUND OF THE INVENTION

Shipping containers for transporting temperature sensitive payloads typically include insulation materials, such as foam peanuts, expanded foams, etc. Various other containers have employed phase change materials to protect the payload from hotter or colder ambient temperatures during shipping. There is an urgent need for an environmentally friendly or "green" container and method of use for maintaining the payload temperature within a narrow band and which can operate without an electrical power source.

Many packages and methods are currently employed to ship temperature sensitive products. Often, these packages and methods require specified thermal preparation. For example, known methods of temperature sensitive material product recovery require on site thermal preparation, or just in time delivery of properly thermally prepared packaging. Methods also exist in which a mechanical device is activated, such as a device that evaporates water into a vacuum and uses the latent heat of vaporization to chill and maintain the temperature of a payload. Such systems are complex and expensive. A passive shipping package with no moving parts is particularly needed.

Temperature sensitive materials such as vaccines are sent to remote locations for use. Often unused materials are wasted for lack of adequate temperature control equipment at the remote location. As the temperature sensitive materials may initially be in usable condition, a method to recover remotely located temperature sensitive materials is urgently needed.

BRIEF SUMMARY OF THE INVENTION

A transport package is described herein which efficiently maintains payload temperature within a predetermined temperature range during delivery through regions having ambient temperatures outside the desired range. The transport package is used for transporting temperature sensitive materials and thermally protecting the materials from cold and hot ambient temperatures in a manner that does not require a power source or other mechanical devices.

Aspects of the invention relate to a temperature maintaining packaging system having an outer container, thermal insulation materials and two or more different phase change materials. Methods of using such packages within hostile environments are disclosed.

Aspects of the present invention also include a package having at least two different phase change materials, with one or more phase change material being thermally conditioned prior to insertion into the container. In some examples of the invention, one or more of the other phase change materials act as a thermal buffer to maintain the payload temperature within a desired temperature range. Prior to package assembly, a phase change material may be cooled or heated to temperatures outside the desired temperature range. With proper selection of the phase change materials, the package can maintain the payload temperature within the desired temperature range throughout the delivery process. Methods of assembling a container and methods of using such a container are also disclosed herein.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
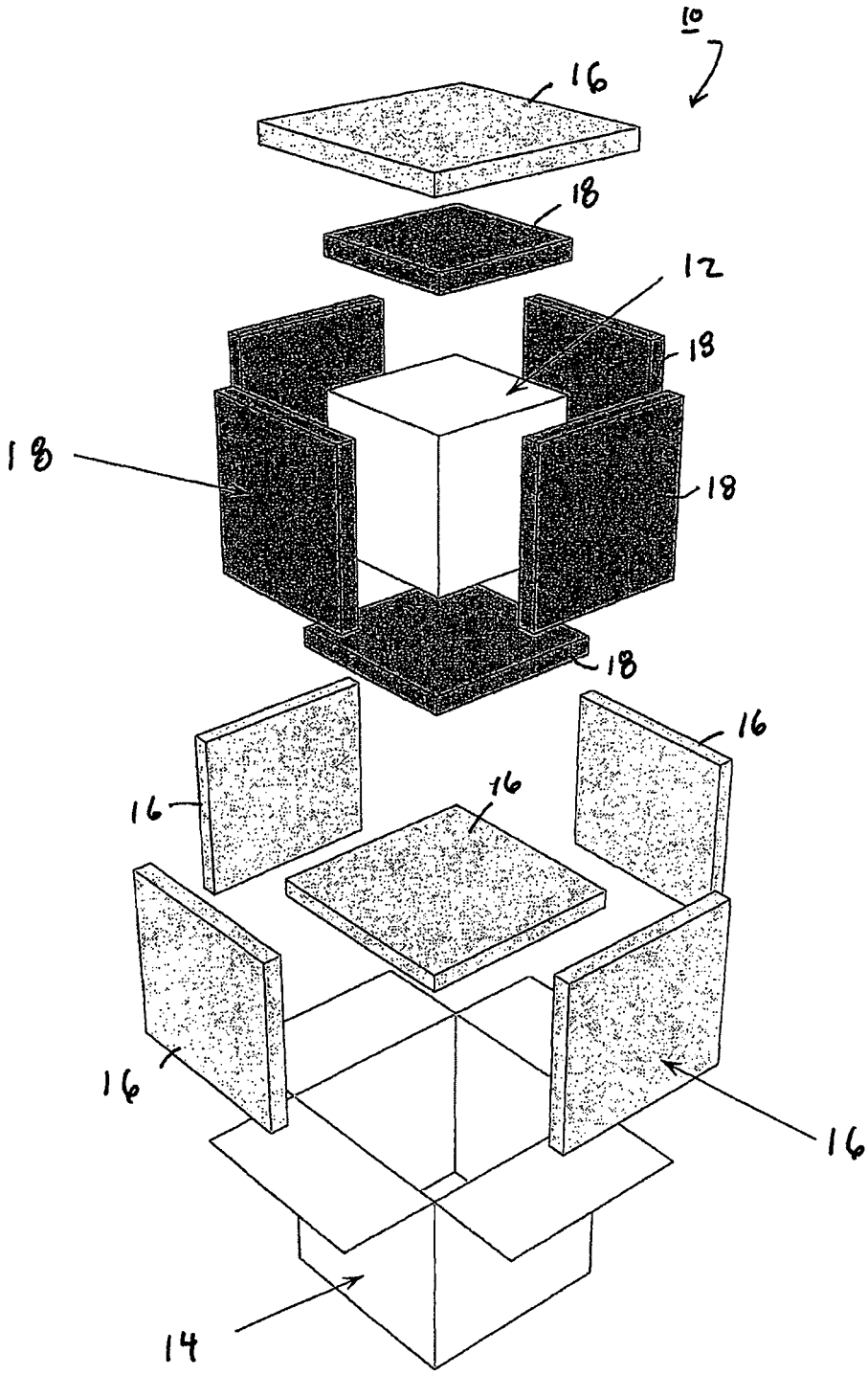
FIG. 1 is a perspective illustration of one embodiment of a package utilizing a phase change material combination in accordance with the present invention.

A phase change material is a substance with a high heat of fusion which, melting and solidifying at certain temperatures, is capable of storing or releasing large amounts of energy. Initially, solid-liquid phase change materials perform like conventional heat storage materials; their temperature rises as they absorb heat. Unlike conventional heat storage materials, however, when phase change materials reach a phase change temperature, i.e., melting point, they absorb large amounts of heat without a significant rise in temperature. When the ambient temperature around a liquid material falls, the phase change material cools and solidifies, releasing its stored latent heat. Certain phase change materials store 5 to 14 times more heat per unit volume than conventional heat storage materials such as iron, masonry, or rock.

Phase change materials can be broadly grouped into two categories: "Organic Compounds", including but not limited to propylene and/or ethylene glycols and "Salt-based Products", including but not limited to Glauber's salt. The most commonly used phase change materials are salt hydrides, fatty acids and esters, and various paraffins, such as octadecane. Certain ionic liquids have also been identified as promising phase change materials.

One embodiment of the present invention provides an efficient method of packaging realizing a reduction in the use of higher-priced phase change materials. Desirably, the packaging includes water-based phase change materials, which are among the least expensive phase change materials in current use. Water has a transition temperature close to 0 degrees C. Water-based phase change materials are often not suitable for certain temperature sensitive products. Other, generally more expensive, phase change materials may be necessary to avoid thermal damage to the temperature sensitive product. For example, red blood cells are temperature sensitive and should not be subjected to temperatures below 1 degree C. The temperature of sub-cooled water-based phase change materials may be significantly lower. As a result, if water based phase change materials are employed, sufficient insulation is typically needed between the temperature sensitive payload and the water based phase change material.

Embodiments of the present invention employ a second phase change material to act as a thermal buffer between a water based phase change material and the temperature sensitive payload. In one example, the second phase change material solidifies while protecting the payload from the temperature of the colder or hotter water based phase change material. In one example, the second phase change material is initially in solid form and then used as a heat sink to protect the payload from heat.

In another embodiment the thermally conditioned phase change material is heated to a temperature above the desired range of protection for the payload. In such an embodiment, the second phase change material again acts as a thermal buffer so as to maintain the payload temperature within the desired range. As a result, it is envisioned that embodiments of the present invention will be utilized to protect a payload against ambient temperatures that are hotter or colder than the payload's desired temperature range.

Embodiments of the present invention may also protect the payload from ambient temperatures that are both colder and hotter than the desired payload protection temperature range. If the ambient temperature is colder than the desired protection temperature range during one period of the package delivery, some period of time may be necessary in order to precondition the liquid phase change materials.

The present invention also promotes efficient packaging methods for thermally acclimating phase change materials. For example, a water based phase change material can be placed into the package directly from the freezer or other suitable preparation device. For example, the phase change material can be stored in solid or liquid form and then, along with the temperature sensitive payload, be packaged without having to wait for the phase change material to arrive at a desired packaging temperature.

The present invention is also directed to a package and method for encasing a payload cavity with phase change materials and insulation. In one example, a water based phase change material is combined with another phase change material to provide thermal protection for the payload. By properly selecting the phase change materials, a package can be configured to provide maximum thermal protection for a temperature sensitive product during delivery. Employing a combination of solid and liquid phase change materials in the container can provide protection from both hotter and colder ambient temperatures during delivery, and a beneficial reduction in the amount of phase change materials can result.

With reference to FIG. 1, there is shown an exploded perspective view of a package 10 for shipping a temperature sensitive payload 12. As depicted, package 10 is prepared for transport by inserting the components and payload 12 into the outer container 14. The components of package 10 include insulation contained within or defined by an insulation panel 16 and phase change material contained within separated panels 18. Six phase change material panels 18 and six insulation panels 16 are employed in the package 10 of FIG. 1. The temperature sensitive payload 12 is received within a payload cavity, defined generally as the interior volume contained within the walls of panels 18. In the illustrated embodiment, container 14 assumes a generally cubic form. In other embodiments, container 14 may assume alternative forms, including but not limited to cylinders, etc. Container 14 may be corrugated paper or corrugated plastic or other suitable material.

Insulation panels 16 can include vacuum insulation panels and/or foams and fiber-based materials. A combination of different insulation materials may be used to form the panel 16.

While panels 16, 18 are shown in rectangular form, each panel can assume a variety of different shapes and forms in alternative embodiments of the invention. For example, panels 16, 18 may be defined as open cylinders with one panel being inserted into the other in a nesting manner. In other examples, panels 16, 18 may be shaped in relation or allowed to conform to the payload 12. Panels 16 may be defined by plastic and/or metal shells for containing phase change material therewithin. Phase change material panels 18 may assume different shapes or forms in alternative embodiments. Examples of phase change material panels 18 can include HDPE containers, form fill and seal films, or any other suitable containers sized to be inserted into the package 10.

Selection of the phase change materials may include consideration of multiple factors including, but not limited to, the desired protected temperature range, anticipated ambient temperatures during shipment, thermal properties of the different phase change materials, thermal properties of the container and/or insulation panels, and thermal properties of the temperature sensitive product being shipped. The design and sizing of containers for the phase change material panels and the insulation panels would vary depending on these factors as well.

Figure 2:
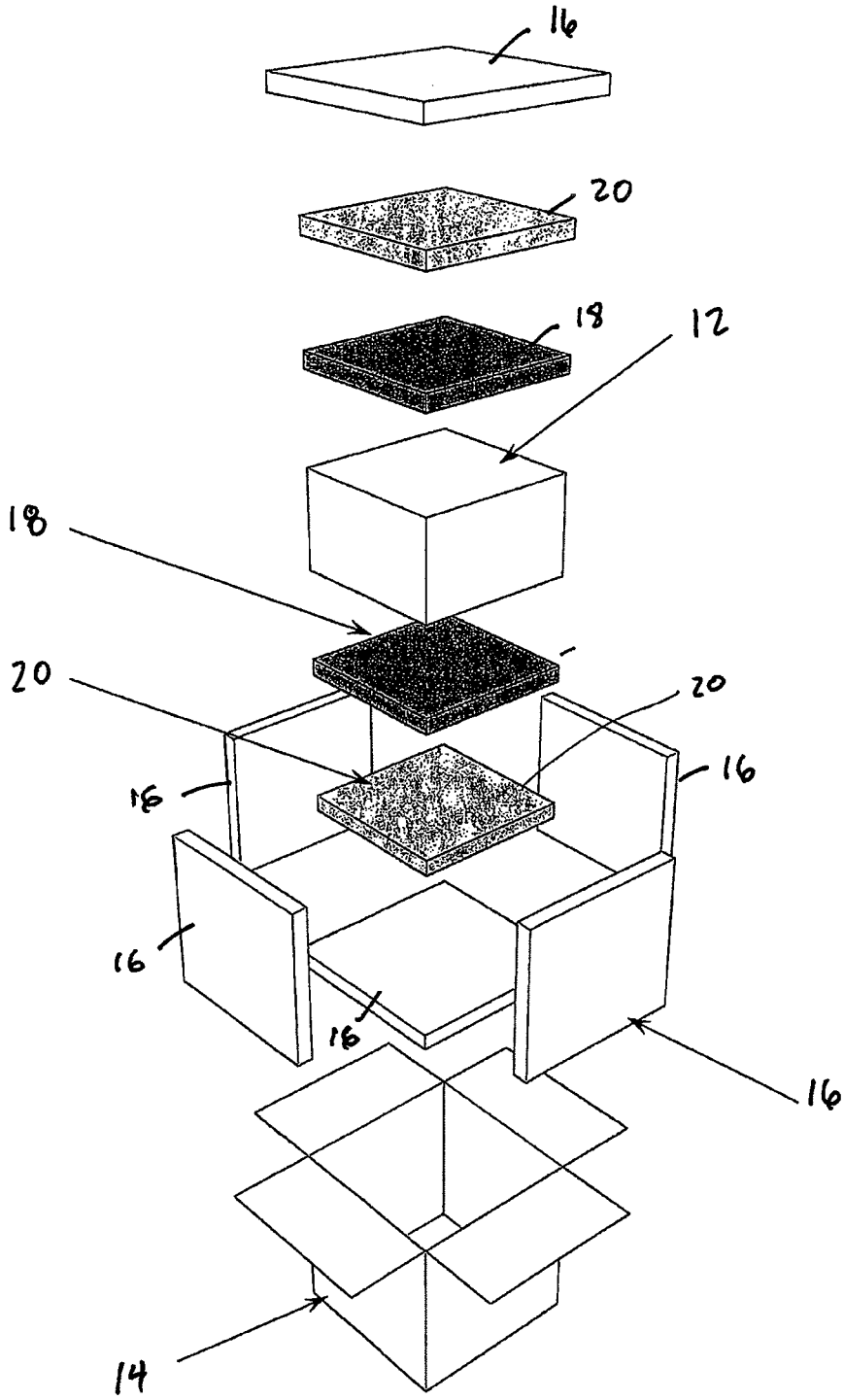
FIG. 2 is a perspective illustration of a second embodiment of a package utilizing a phase change material combination in accordance with the present invention.

FIG. 2 illustrates another embodiment of the present invention. In this example, package 10 includes a pair of phase change material panels 18, 20 placed above and below payload 12. The payload cavity is thus defined between the four walls of insulation panels 16 and two inside walls of phase change material panel 18. In this embodiment, the primary heat transfer occurs through the top and bottom portions of package 10.

An exemplary package 10 in accordance with the present invention includes phase change materials in different layers relative to the payload. Prior to shipment one or both of the phase change materials can be preconditioned into liquid or solid form. Depending on the anticipated ambient temperature profile during transport of package 10, an effective combination of solid and liquid phase change materials can be selected. If additional protection is needed, auxiliary phase change materials in solid, liquid, or solid and liquid phase can be added to augment the thermal capabilities of the package 10.

In another embodiment, the payload cavity may initially contain a phase change material form that is thermally prepared to be solid, liquid, or solid and liquid based on anticipated ambient temperatures during delivery and the protection requirements of the payload. In yet another embodiment the functions of container 14 and phase change panel 18 may be combined into an integrated structure. In such an example, the container 14 and phase change panel 18 would together be thermally conditioned prior to package 10 assembly. Similarly, the insulation panels 16 and one or more of the phase change material panels 18, 20 may be combined into one or more structures.

One embodiment of the present invention includes an outer container into which one or more insulation panels and multiple different phase change material panels are inserted. A payload cavity within the container is sized to receive a temperature sensitive product. In one example, a water based phase change material is combined with another phase change material. The two phase change materials cooperate to provide thermal protection for the temperature sensitive product even, for example, if the water-based phase change material is sub-cooled. For example, a package 10 for shipping blood products may include a first water based phase change material and a second phase change material which is liquid near 4 degrees C. A method of shipping such package 10 would include cooling the water-based phase change material below zero degree C. prior to insertion into package 10.

The temperature sensitive payload can be wrapped, encased, or placed adjacent a phase change material and together covered with another phase change material. During shipping, one of the phase change materials may initially solidify the other phase change material without thermal damage to the payload.

Other embodiments of the present invention include two or more different phase change materials. In one embodiment, a water-based phase change material is utilized along with a non-water-based phase change material. In another embodiment, a phase change material panel protects a temperature sensitive payload against thermal damage from a colder or hotter water-based phase change material. Depending on the desired temperature range, a variety of different phase change materials may be utilized to keep a temperature sensitive product warm or cold during shipment through an environment having substantially different temperatures than desired.

While the embodiments of FIG. 2 illustrates a water-based phase change material separated from the temperature sensitive payload by an intermediate phase change material, in other embodiments of the present invention a water-based phase change material is positioned between an outer phase change material and the temperature sensitive product.

Figure 3:
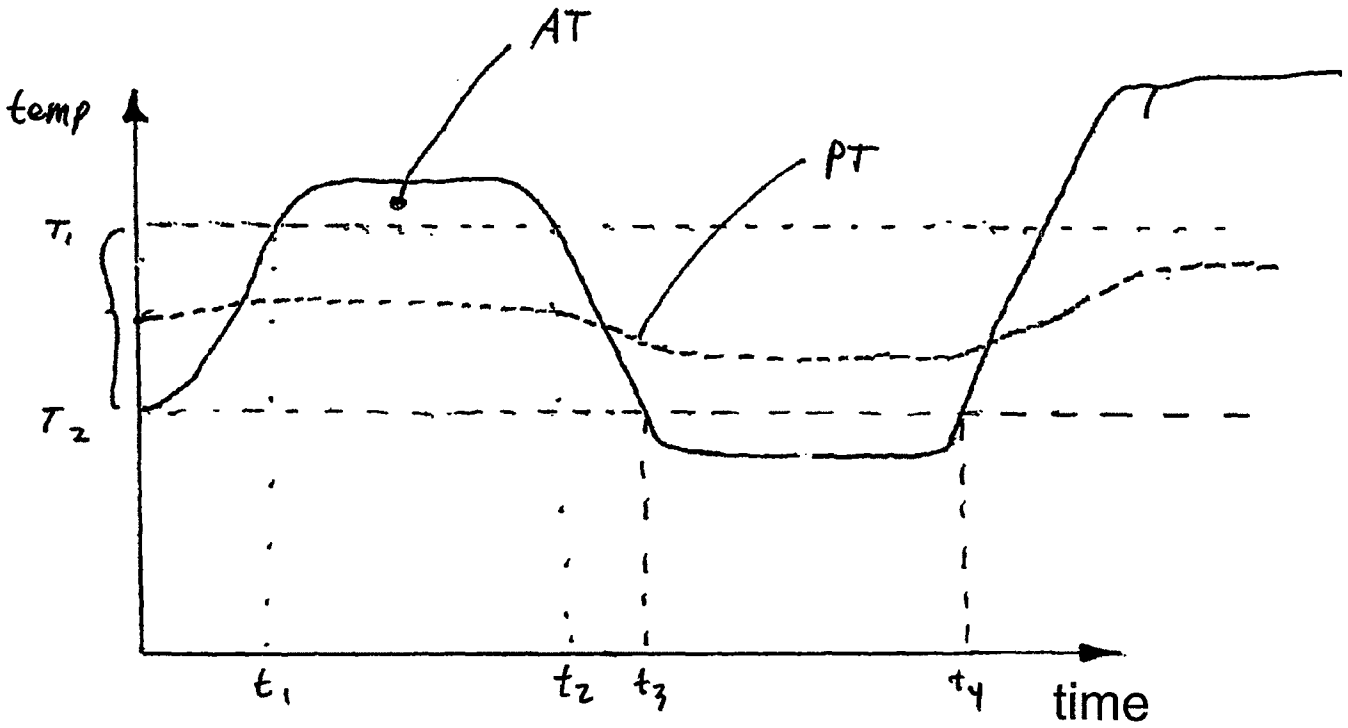
FIG. 3 is a temperature vs. time diagram showing heat transfer to and from a package in accordance with the present invention during a delivery period.

FIG. 3 depicts a change of payload temperature during a hypothetical delivery process of a package 10 in a hostile environment. During the delivery process the ambient temperature, shown as line AT, changes to be outside the desired product protection range. In this example, package 10 maintains the payload temperature, shown as line PT, within the desired temperature range for product protection, defined between temperatures, T1 and T2. During a time period between t1 and t2, the ambient temperature of package 10 is higher than the desired range. During such period a solid phase change material panel absorbs heat without a substantial increase in the payload temperature. Similarly, during a time period between t3 and t4, with the ambient temperature lower than the desired range, the phase change material panel would transfer heat to the payload.

The invention further relates to a method for shipping temperature sensitive products from a first location to one or more remote locations including: preparing at a first location a container having insulation materials and phase change materials; receiving the container at a second location; thermally conditioning and replacing at least one of the phase change materials of the package; and inserting a temperature sensitive product into a payload cavity prior to shipment from the remote location to yet another location. The phase change materials may initially include two different phase change materials.

Other examples of the invention provide a method for transporting a temperature sensitive product including: receiving a container including multiple phase change materials and insulation, the phase change materials being thermally preconditioned prior to and/or during delivery; thermally conditioning one of the phase change materials to a temperature outside of a desired temperature range for protection of the thermally sensitive product; and placing the temperature sensitive product into the payload cavity prior to shipping the container to another site. In a preferred form, one of the phase change materials is utilized to buffer the temperature of the temperature sensitive product during shipment. As a result, the temperature sensitive product can be protected against thermal damage caused by a phase change material having a temperature outside of the desired temperature range for product protection.

The present invention is also directed to a transport method where the payload cavity is initially filled with a phase change material prior to transport to a remote location and the payload cavity is cleared prior to delivery from the remote location. In one example, some or all of the phase change material is removed from the payload cavity at a remote location. A temperature sensitive product is then placed into the payload cavity and the container is resealed and delivered to another location. Such an example provides a method for recovering temperature sensitive material from a remote site that does not have adequate thermal control equipment. For example, a remote site may have a small refrigerator but not a freezer. When the package arrives at such a remote location, a flu vaccine clinic for example, some amount of the phase change material is removed from the container and the temperature sensitive material is placed into the container for shipping to another location.

Another embodiment of a package of the present invention provides phase change materials in different states on different sides of the payload. For example, a phase change material panel 18 in solid form is placed on one side of the payload and phase change material panels 20 are placed on the other sides of the payload. In other examples, two sides can be in solid form while four sides are in liquid form, three sides can be in solid form while three sides are in liquid form, four sides can be in solid form while two sides are in liquid form, and five sides can be in solid form while one side is in liquid form. The panels 18, 20 on each side of the configuration can be made into two or more panels placed together to make many other combinations of panels possible. Depending on the anticipated ambient temperature profile, the most effective combination of solid and liquid phase change material can be selected. If additional protection is needed and space is available within the payload cavity, auxiliary phase change material in solid, liquid, or solid and liquid phase can be added to augment the encasement phase change materials.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A package for transporting a temperature sensitive payload comprising:

a container defining an interior volume;

a plurality of insulation panels contained within the interior volume;

a first hollow generally rectangular panel contained within the interior volume, said first hollow panel containing a first phase change material;

a second hollow generally rectangular panel in thermal contact with the first hollow panel, said second hollow panel containing a second phase change material;

preconditioning some of the plurality of phase change material into solid form; and preconditioning a different some of the plurality of phase material into liquid form, wherein some of said plurality of phase change material changes phase from liquid to solid above a lower protection temperature and the different some of said plurality of phase change material changes from solid to liquid below a higher protection temperature, said lower and higher protection temperatures defining the temperature range for payload protection.

2. The package of claim 1 wherein the payload is substantially surrounded by one of the plurality of phase change materials.

3. The package of claim 1 wherein the payload is substantially surrounded by two of the plurality of phase change materials.

4. A method for shipping a temperature sensitive payload within an insulated container comprising:

thermally conditioning a first rectangular panel containing one of a plurality of phase change materials to a temperature outside a desired temperature range for thermal protection of a payload within the container;

thermally conditioning a second rectangular panel containing a different one of the plurality of phase change materials to a temperature within the desired temperature range;

inserting the second panel adjacent a payload volume;

inserting the first panel, with said second panel separating the first panel from the payload volume, with said second panel thermally buffering the payload volume from thermal damage from the first panel and;

inserting insulation panels around the payload volume, with both of said first panel and said second panel being positioned between at least one of the insulation panels and the payload volume.

5. The method of claim 4 wherein said conditioning includes obtaining an estimate of temperatures through which the container will pass during transport, and conditioning at least one of the plurality of phase change temperatures based on said estimate.

6. The method of claim 4 wherein the payload is substantially surrounded by one of the plurality of phase change materials.

7. The method of claim 4 wherein the payload is substantially surrounded by at least two of the plurality of phase change materials.

8. A package for transporting a temperature sensitive payload comprising:

a plurality of insulation panels being placed within a container interior;

a plurality of panels containing phase change materials being placed within the container interior, with at least one panel including a phase change material being thermally preconditioned to a temperature outside of a desired thermal protection range of a temperature sensitive payload and at least another panel including a different phase change material being thermally preconditioned to a temperature within the desired thermal protection range, with said second panel thermally buffer the payload from thermal damage from said first panel; and a payload section sized to receive the temperature sensitive payload, said payload section being defined upon removal of at least some of the plurality of phase change materials from the container upon delivery to a remote location.

9. The package of claim 8 wherein the payload section is defined within one of the plurality of phase change materials.

10. The package of claim 8 wherein the payload section is enclosed by at least two of the phase change materials.

11. The package of claim 8 wherein the insulation and the plurality of phase change materials are provided in separate containers.

12. The package of claim 8 wherein only some of the phase change materials are water-based.

* * * * *